US005111918A

United States Patent [19]

Bako et al.

[11] Patent Number: 5,111,918

[45] Date of Patent: May 12, 1992

[54] ROLLABLE SUITCASE

[75] Inventors: Laszlo Bako, Solingen; Helmut Klein, Velbert, both of Fed. Rep. of Germany

[73] Assignee: S. Franzen Söhne (GmbH & Co.), Solingen, Fed. Rep. of Germany

[21] Appl. No.: 666,726

[22] Filed: Mar. 8, 1991

[30] Foreign Application Priority Data

May 25, 1990 [DE] Fed. Rep. of Germany ..... 9005955
Oct. 26, 1990 [EP] European Pat. Off. ..... 90120574

[51] Int. Cl.[5] ..... A45C 5/14; A45C 13/26

[52] U.S. Cl. ..... 190/18 A; 70/73; 70/74; 70/312; 190/115; 190/120; 190/121; 292/113

[58] Field of Search ..... 190/18 A, 115, 119, 190/120, 121; 70/72, 73, 74, 75, 312; 292/106, 113, DIG. 42, DIG. 49

[56] References Cited

U.S. PATENT DOCUMENTS

| | | | |
|---|---|---|---|
| 3,030,137 | 4/1962 | Cheney | 70/74 |
| 3,237,978 | 3/1966 | Swanson | 292/113 |
| 3,584,906 | 6/1971 | Budzyn | 70/73 |
| 3,805,929 | 4/1974 | Kuwayama | 190/115 |
| 3,828,899 | 8/1974 | Scott | 190/120 |
| 4,008,584 | 2/1977 | Wingert | 70/73 |
| 4,299,313 | 11/1981 | Null | 190/115 |
| 4,509,622 | 4/1985 | Morszeck | 190/119 |
| 4,544,050 | 10/1985 | Seynhaeve | 190/115 |
| 4,920,771 | 5/1990 | Jiang | 70/312 |
| 4,928,800 | 5/1990 | Green et al. | 190/18 A |

FOREIGN PATENT DOCUMENTS

| | | | |
|---|---|---|---|
| 8702553 | 5/1987 | World Int. Prop. O. | 190/119 |

*Primary Examiner*—Gary E. Elkins
*Attorney, Agent, or Firm*—Martin A. Farber

[57] ABSTRACT

A suitcase (K) consists of two suitcase shells (1) and (2), which can be folded together, and includes castors and a pull handle (Z). The pull handle is on the narrow side (14) opposite the castors, and is swingably seated on a mounting plate (17) attached to the other suitcase shell (2). The suitcase shell (2) is adapted to be connected to the opposite suitcase shell (1) by at least one closure which extends over a fold joint (3) of the suitcase. This achieves a structurally advantageous configuration which is stable in use due to an interpenetration between hasp closure (I) and the mounting plate.

30 Claims, 13 Drawing Sheets

K
II
13'
33/43
19
1
13
I
41
44
III
14
8
R
7
6
5
St
9
12
E
T
21
20
VII
17
Z
68
66
2
14
43
33
4
48

17
62
20
22
60
16
60
65
Z
66
69
61
17'
62
61
15

17
20
22
15
Z
69'
69
60
63
60

Z
60
60
60

17
17'
65
Z
27
20
60
60
67
60
68
66
69

17
Z
20
66

17
Z

FIG.16
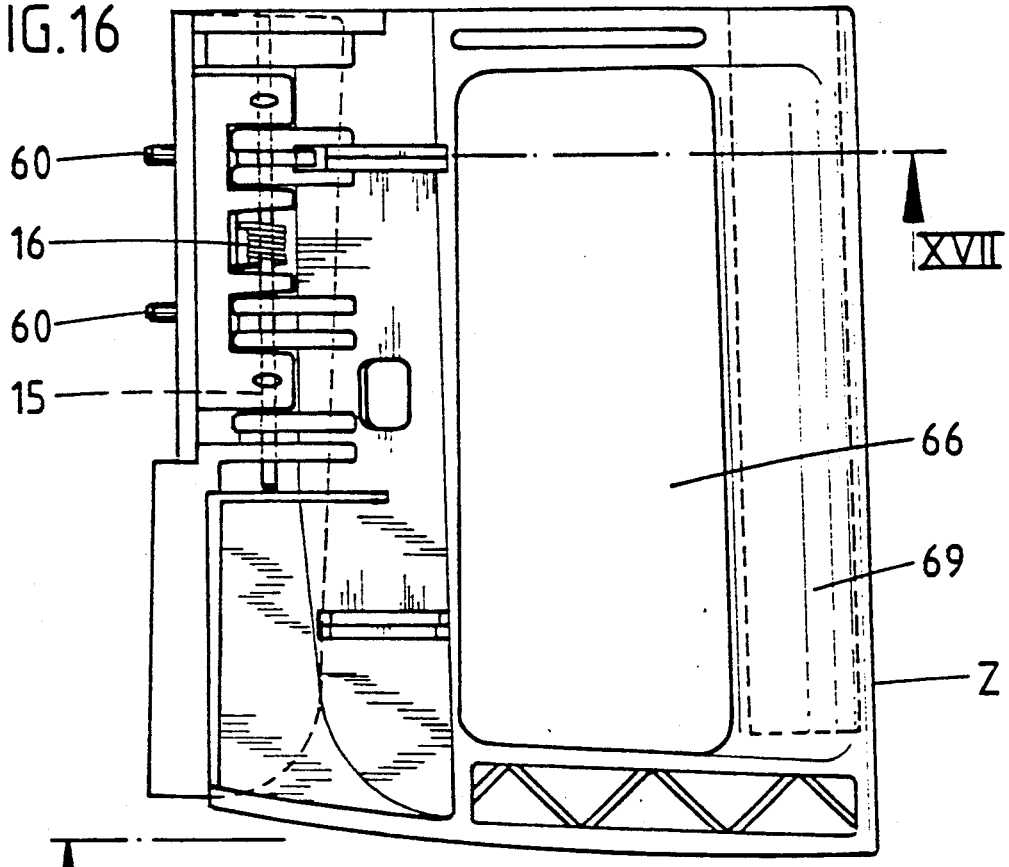
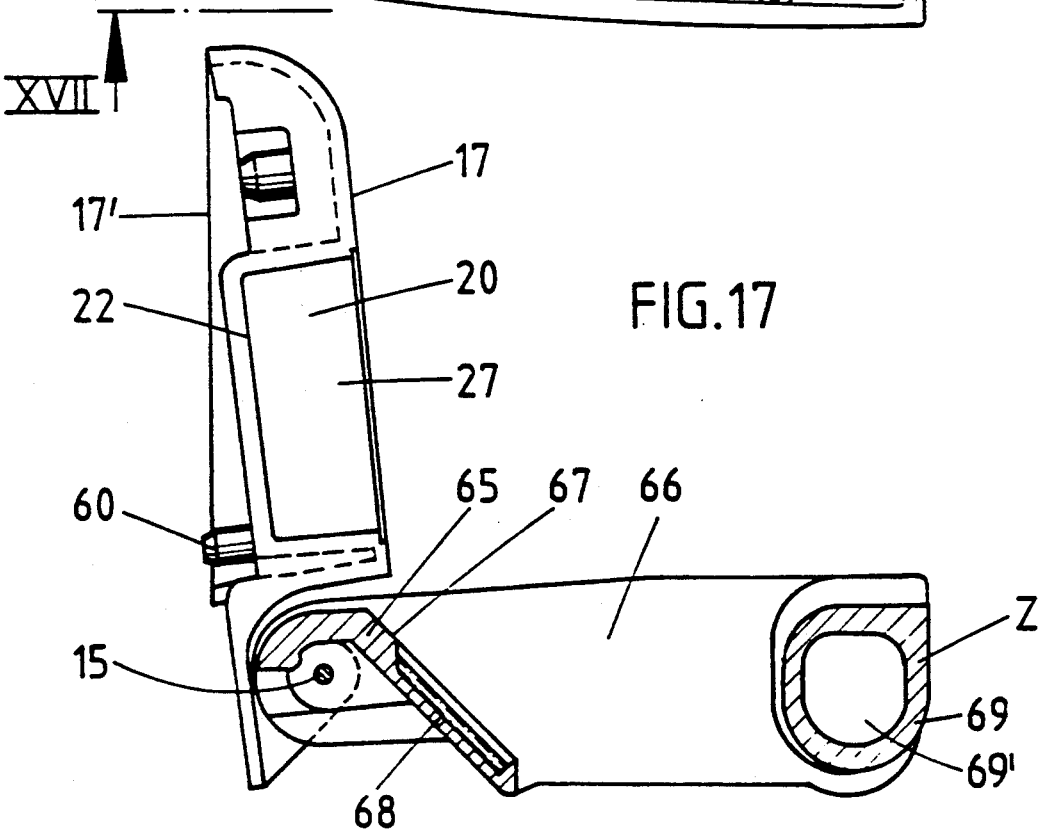
FIG.17

ROLLABLE SUITCASE

FIELD AND BACKGROUND OF THE INVENTION

The present invention relates to a suitcase which consists of two suitcase shells which can be swung together and is provided with castors.

A rollable suitcase of this type is known from Applicant's Federal Republic of Germany Patent 38 11 280. In that case, the closures which extend over the opening edge of the suitcase shells are developed as suitcase locks. They are present at a definite distance from the corners of the suitcase on both sides of the carrying handle and, therefore, on the top side of the standing suitcase.

SUMMARY OF THE INVENTION

The object of the present invention is to improve a suitcase of this type with respect to the attachment of the closure means and, in particular, to optimize it in regard to its stability.

As a result of the present invention, there is obtained a suitcase of this type which is of increased value in use: The main emphasis is placed on this connection in the integration of the closure parts, furthermore, the achieving of high stability of the closure, particularly at places subject to high loads since the generally excessive degree of filling such a suitcase acts in full on the elements which connect the suitcase shells to each other. In addition to this, there are external loads via the carrying handle and above all via the pull handle. The invention solves this by interaction between hasp closure and mounting plate. Thus, two functional elements are placed, so to say spatially combined, in the region of the pull handle. Since the pull handle is as a rule placed in the region of the inherently stable, upper corner of this type of suitcase, the corresponding addition results in a further stabilization from the fitting parts. In other words, forces entering via the closure which extends over the opening edge are taken up in favorable manner by the mounting plate on which the pull handle is attached. If the attachment base is included, namely, the wall of the suitcase shell, than this place of load is optimally equipped despite the possibility of providing small wall thicknesses. On the other hand, forces acting via the pull handle pass via the hasp closure also to the other shell of the suitcase; the load is thus distributed practically over the entire suitcase. In order to keep undesired mechanical stresses away from the actuating means of the hasp closure, it is further proposed that the mounting plate have a depression into which a hasp-closure actuating lever of the hasp closure engages. The actuating means can thus be brought into a protected concealed position. Due to the plate-shape of the mounting plate, such depressions, which can be produced by deep drawing or injection molding, simultaneously result in a high inherent stability of the mounting plate itself, due to poly-directional wall sections. It is favorable in this connection for the bottom of the depression to rest on the wall of the shell. This direct support, namely, favors the stabilizing attachment to the shell wall. It is furthermore advantageous for a hook engagement member for the hasp-closure actuating lever to be seated on the bottom of the depression. This recessed position of the hook-engagement member also avoids any undesired catching on other objects. Furthermore, a protected position of this mating closure part results. The hook engagement member is seated in advantageous manner on a base plate of the hasp closure. It is also advantageous for the top side of the hasp-closure actuating lever to be aligned with the upper edge of the depression and for the depression to leave a free engagement space on the other side of free edge of the hasp-closure actuating lever. It is sufficient for such free engagement space to be two or three fingers wide. Except for this window, which forms the free engagement space, the actuating lever passes smoothly and continuously, i.e. without steps, into the wall of the shell. The free engagement space forms not only the exposing of a bottom-side region of the actuating lever which can be handled, but, as further advantageous development, also the access to the locking means which are provided below the hasp-closure actuating lever in the form of an unbolting slide which cooperates with the above-mentioned hook engagement member in the manner of a latch. Such an unbolting slide is urged by spring towards its basic position. As a logical continuation of the association of the hasp closure which avoids an exposed protruding position, the invention furthermore proposes that the closure arm of the hasp-closure actuating lever which arm forms a hook at its end, be bent in longitudinal direction and that its convex top side lie in a slot in an edge bead which consists of two approximately quarter-bar-shaped edge beads of the two suitcase shells. With suitable depth of the slot the top side of the closure arm, therefore, also disappears in the shell wall of the suitcase profile. At least one of the outwardly protruding edge beads can receive a rubber gasket. The invention, furthermore, proposes that the mounting-plate-side arm of a pull-handle lug form a roof-like ascending flat surface having a name-plate compartment. With outside enlargement of the lug, the flat surface is inclined obliquely downward on the suitcase side. The pull handle can also fit snugly into the contour of the suitcase body without protruding. Arranging the name-plate compartment in the mounting plate-side, i.e. the hinge-side section of the frame-like handle body is of substantial advantage in use since this arm does not form the actual grip handle but rather the parallel arm which is further away from the hinge place. Thus, no traces of grasping are produced which could make the name plate illegible or scratch a transparent cover thereof. Furthermore, the name-plate compartment is thus also imparted a somewhat concealed position so that the name and possibly even the address of the owner of the suitcase are not disclosed too obviously to everybody. Also with respect to stability, namely, the locking stability of the suitcase, it is advantageous to provide, symmetrical to and opposite the hasp-closure actuating lever on the pull handle-side, a second, similarly developed hasp closure having a corresponding actuating lever. This lever is also placed in the inherently extremely stable corner region of the other narrow side of the suitcase. The adaptation on the suitcase-side with regard to the recessed arrangement of the functional parts is also taken into account here. In the other integral development, such an arrangement consists, as a further development, therein that the pull handle together with the mounting plate are recessed in an inward niche in the cell wall. Another association-adapted favorable development consists therein that the edge of the mounting plate extends on the head side (top side) of the suitcase congruent to a rounded contour there of the corresponding suitcase shell with which contour the shell bottom enters into the upper shell wall on the suitcase carrying handle side. As seen in profile, there is preferably present a shape comparable approximately to a classical typewriter case. Referred to the mounting plate, there results the logical arrangement of providing the relatively small functional part, i.e. the hasp closure in the upper zone of tapered cross section and of developing below same, in the clearly wider zone, the hinge place for the pull handle and arranging the latter there. It is, furthermore, favorable with respect to the version of the hasp closure without mounting plate that the second hasp-closure actuating lever is also recessed in a slot formed by the edge bead and in a depression in the shell wall. It is, furthermore, proposed that the edge bead leave free a third slot symmetrically adjacent the carrying handle of the suitcase in which there is recessed a third hasp closure, the hasp-closure actuating lever of which, however, bears in this case a combination lock for blocking a bolt slide arranged below the hasp-closure actuating lever. In this way, the narrow longitudinal side of the suitcase remote from the folding hinge of the suitcase is optimally secured by locking. A structurally favorable solution consists in this connection in the fact that the bolt slide develops bolt latches on both sides of the combination lock housing which latches grip under locking noses which are seated on the narrow sides of the bearing pedestals for the suitcase handle, between which bearing pedestals the hasp-closure actuating lever engages in the manner that the bolt-slide actuating surface lies free, spaced from the inner side of the unfolded suitcase carrying-handle yoke. In this case also, there is thus obtained with very simple means the free engagement space for the actuating hand discussed above with respect to other hasp closures. Regardless of the specific position in which the suitcase is being used, the suitcase carrying-handle yoke always remains folded down. For this purpose, it is urged by spring in the folded-down direction; its strikes against the bottom surface of a carrying handle trough which is created in the manner that said surface lies in secant shape with respect to the rounding contour of the shell wall. The carrying-handle yoke can nevertheless be readily grasped, in view of the fact that the carrying-handle yoke arm is aligned with the transition edge of the bottom surface in the rounding and with its front end forms a gusset with respect to the rounding. The fingers of the carrying hand of the user need only be introduced here in order to swing the carrying handle out against spring action. A particularly simple return-spring means consists in the carrying-handle yoke spring being developed as torsion spring seated on a journal pin of the carrying-handle yoke. An advantageous durable attachment of the preassembled pull-handle unit consists in a sleeve/pin plug-connection between mounting plate and shell wall in addition to the screw attachment. The pins which act as set pins substantially facilitate assembly. It is advantageous for at least one pin to extend from the bottom of the depression. It is, favorable for the hollow bottom side of the mounting plate to have intersecting stabilizing webs with bushings at the points of intersection. Another favorable development also consists of a bushing/pin plug-connection between the base plate of the hasp closure and the shell wall in the region of a receiving space which intersects the one edge bead, namely, in addition to a screw attachment which connects shell wall, bottom of the depression and base plate of the hasp closure. In this way, the hook engagement member arranged on the base plate of the hasp closure is supported on its rear by two additional walls. It is furthermore proposed that the bearing pedestals for the carrying handle be seated on a common ledge and be provided with bearing recesses which have insertion openings on the ledge-stop side for the journal pins of the carrying handle, and that the insertion openings be covered in installed condition by the wall of the suitcase shell. By fixing the ledge on the corresponding suitcase shell, the carrying handle is thus held in a manner proper for operation without the use of special securing means. It is advantageous in this connection for the bearing recesses to extend substantially perpendicular to the direction of the ledge. The carrying handle can in this way be inserted rapidly and reliably with one short transverse stroke; furthermore, the loading forces flow in the direction in which the bearing pedestals extend. A particularly fool-proof association results from the measure that, at a distance from the journal pins, blocking edges are developed on the carrying handle on the yoke side for cooperation with a longitudinal edge of the bearing pedestal which guides upon assembly and a following end surface of the bearing pedestals which surface is convex corresponding to the course of swinging of the carrying handle, for cooperation in the condition of use so that the optional possibility of folding down can be utilized. Furthermore, an association-stable development of the carrying handle also results from the fact that the journal pins form a collar of larger diameter for the rail-like introduction into a corresponding undercut of the bearing recesses. Despite the stub-like shortness of the journal pins, they cannot jump out of the bearing recesses under the action of extreme loads on the carrying handle. The elimination of the axial connection can only be obtained by disassembly. Finally, it is also advantageous for the ledge to form longitudinally on one side, at least in the region of the bearing pedestals, a blocking projection which prevents a pushing in or out of the carrying handle which has been folded in this manner. This measure also contributes to logical assembly. Furthermore, such a blocking projection results in a greater accumulation of material and thus in greater stability for the base-plate-like ledge. It is at the same time advantageous in this connection that, in the region of the blocking projection, the ledge be in form-locked engagement via a longitudinal rib with that suitcase half which has the corresponding longitudinal groove. The invention finally also proposes that on the other side form longitudinally an engagement tongue for engagement in the wall of the suitcase shell which forms the cover of the suitcase. By this engagement tongue, the ledge engages at least partially below the other shell of the suitcase, which contributes to the mutual stabilizing of suitcase shell and carrying hardware.

BRIEF DESCRIPTION OF THE DRAWING

The object of the invention will be explained further below with reference to an embodiment shown in the drawing, in which:

FIG. 16 is a rear view of said unit, namely, with the pull handle swung up into the position of use;

FIG. 17 is a section along the line XVII—XVII of FIG. 16;

FIG. 26 is a cross-section through the one mounting end of the carrying handle;

DETAILED DESCRIPTION OF THE PREFERRED EMBODIMENT

The suitcase K shown consists of two suitcase shells 1, 2 which can be folded together. The one suitcase shell 1 forms the cover of the suitcase; the other suitcase 2 is the case which has the greater depth.

Figures 1, 2, 3:
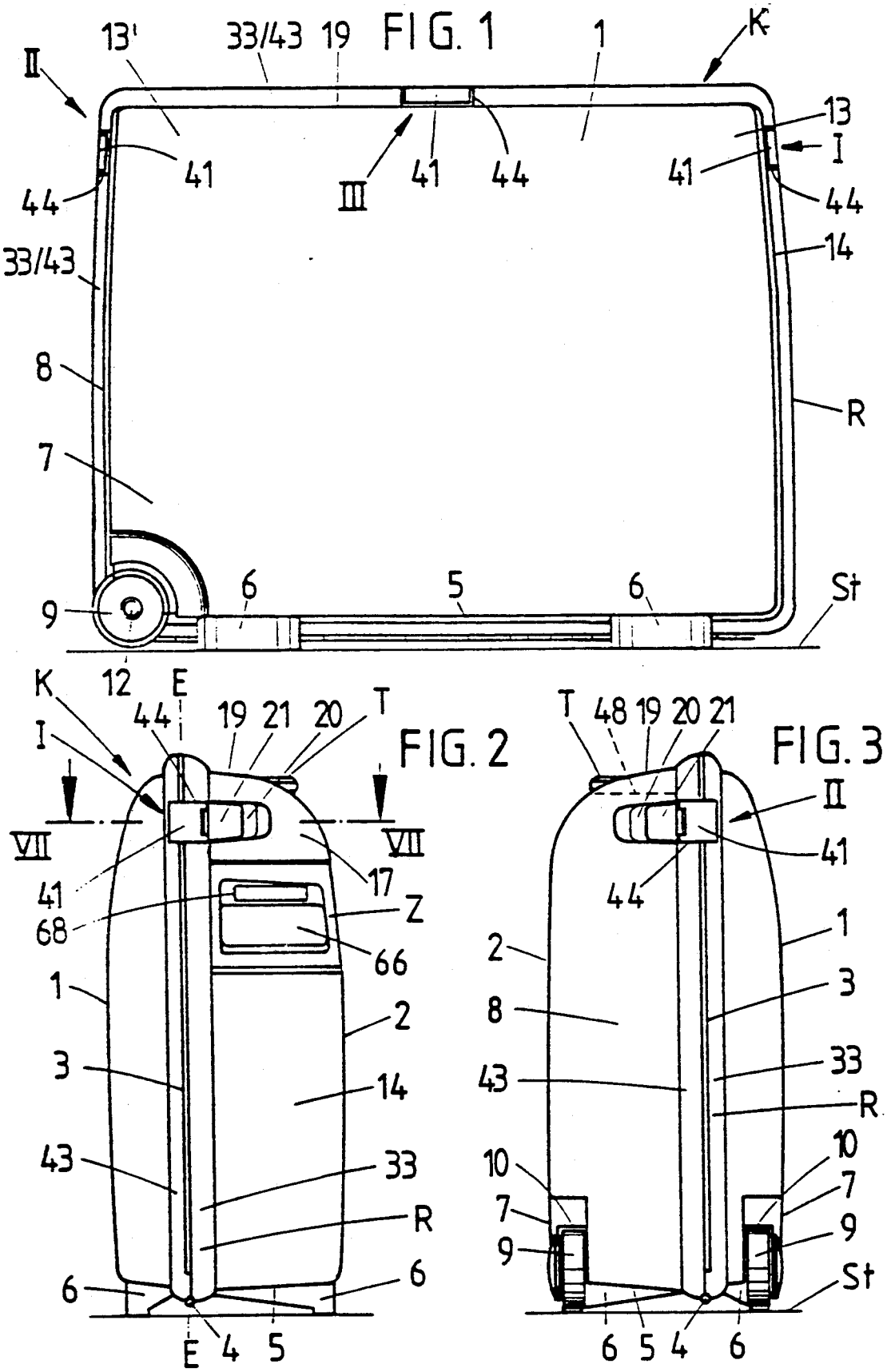
FIG. 1 shows the suitcase of the invention in rear view.
FIG. 2 is a right side view.
FIG. 3 is a left side view.
Figure 4:
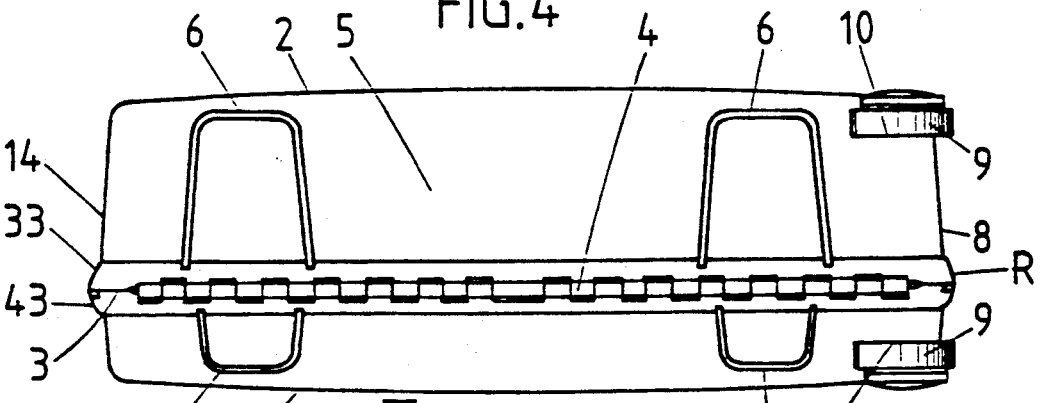
FIG. 4 is a bottom view of the suitcase.
Figure 5:
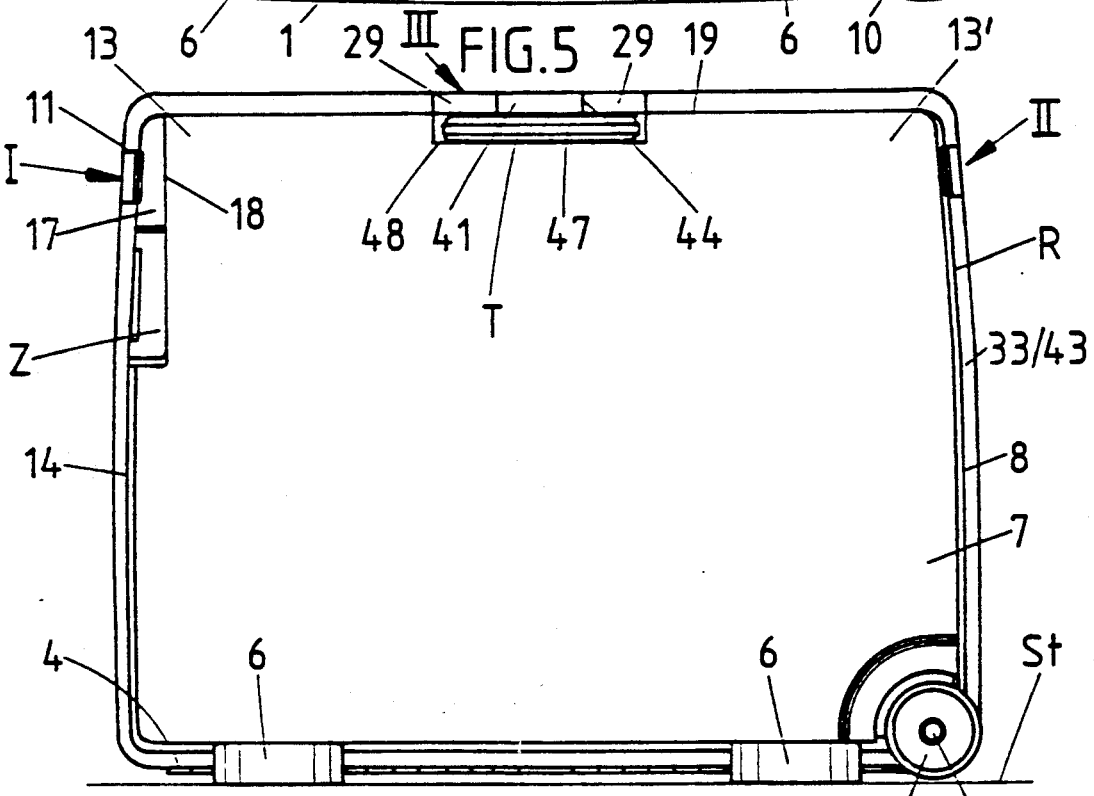
FIG. 5 is a front view.

The ratio of the shell depths is about 1:2. Accordingly, the hinge joint 3 lies asymmetrically. It lies in a vertical plane E—E (see FIG. 1).

A horizontal hinge shaft 4, which connects the suitcase shells 1 and 2 for swinging, is located on the bottom side 5 of the suitcase K. It is a strap hinge which is formed identically on the suitcase 1, 2 which interlocks in meander-like manner and through which merely a longitudinal bar is passed as physical hinge shaft 4.

Standing feet 6 are, furthermore, formed on the bottom side 5 of the suitcase K, these feet at the same time compensate for the slightly ascending course of the wall of the bottom side 5.

In a lower corner region 7 of the narrow side 8 of the suitcase K castors 9 are mounted. There is concerned a pair of castors which, however, are slightly recessed with respect to the wide surfaces of the suitcase shells 1, 2 and are, therefore, received in lateral recesses 10. In the standing position of the suitcase, the periphery of the castors is slightly raised from the resting surface St. The horizontal castor axle which extends transverse to the broad, side of the suitcase bears the reference numeral 12.

The suitcase K which due to the castors 9 is a rollable suitcase has a pull handle Z in diagonally opposite position, i.e. in the region of the upper corner 13 of the other narrow side 14.

The pull handle Z is mounted on said narrow side 14 in such a manner that it can be folded around a horizontal shaft 15 out of its recessed or inserted position into a 90°-position of use. It is urged by a return spring 16 back into the inserted direction.

Together with a mounting plate 17, to which it is connected by a shaft, the pull handle Z forms a preassembly unit.

The preassembly unit 17/Z can be installed in an inwardly recessed niche 18 of corresponding contour in the shell wall W of the deeper suitcase shell 2. The dimensions are so selected that there is no exposed protrusion, rather the shell wall of the suitcase, the outer side of the frame-shaped pull handle Z, and the outer side of the mounting plate 17 terminate in the same plane.

Due to the mounting plate 17, a region of particularly high stability results for the corner region 13 and its extensions since the walls which are connected to each other stiffen each other.

In this region there is, therefore, arranged a hasp closure I which engages over the fold joint 3. Said closure is at a position which is as far as possible from the hinge shaft 4 while being as close as possible to the top side 19 of the suitcase K and it is, therefore, positioned also in the corner region 13 and on the narrow side 14 of the suitcase. There is, thus, an interpenetration from a standpoint of shape and force between hasp closure I and mounting plate 17, the latter acting as intermediary of the preassembly unit pull handle and mounting plate.

Figure 7:
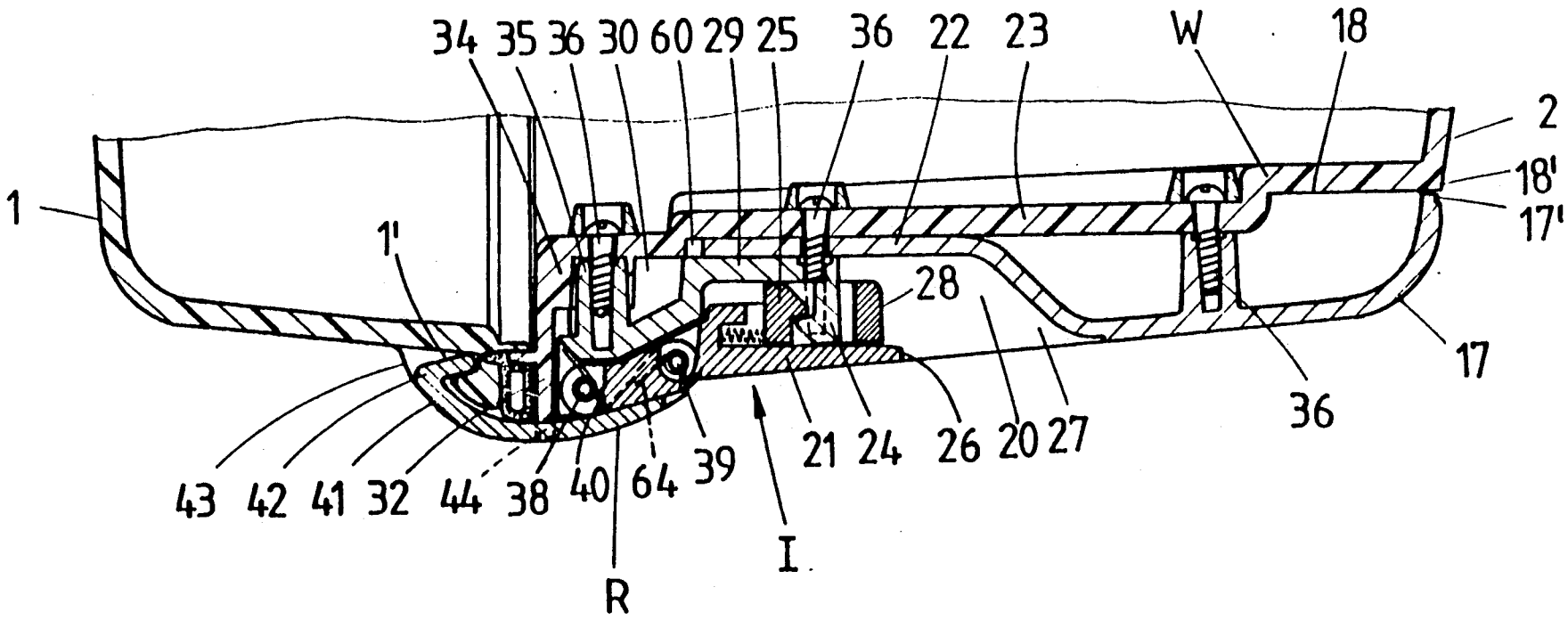
FIG. 7 is a section along the line VII—VII of FIG. 2 showing the spatial engagement of hasp closure and mounting plate in approximately actual size.

Specifically, the mounting plate 17, which follows the shape of the suitcase on the outside, has for this purpose a depression 20 into which a hasp-closure actuating lever 21 of the hasp closure I engages without protrusion in the basic closed position (see FIG. 7).

The depression 20 is a recess which is at least two fingers wide, is adjacent the horizontal shaft 15 of the pull handle Z, and is open in the direction towards the fold joint 3, thus imparting a meander-shaped course to the profile of the mounting plate 17. The bottom 22 of the depression 20 rests snugly against the shell wall W or, stated more precisely, even against a depression ledge 23 which is directed opposite the depression 20 and the shape of which can be noted clearly from FIG. 14. The corresponding wall offset of the depression ledge 23 corresponds approximately to the wall thickness of the shell wall W.

Figure 23:
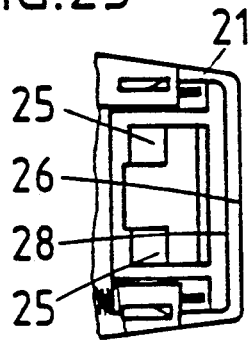
FIG. 23 is a partial bottom view corresponding to FIG. 22, exposing the bottom side of the actuating lever of the hasp closure.
Figure 19:
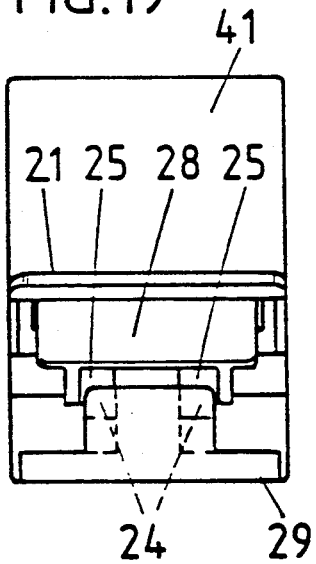
FIG. 19 is a right side view.

On the bottom 24 of the depression 20 there is seated a hook engagement member 24. With the latter the actuating lever 21 of the hasp closure I cooperates in engaging manner, detachable by deliberate action. The actuating lever 21 bears for this purpose on its bottom side a frame-shaped push-slide which is urged by spring in the closing direction, designated as unlocking slide 25. It can be noted particularly clearly from FIG. 23. The unlocking slide 25 is attached by clip attachment. In order for it to be accessible, the depression 20 leaves a free engagement space 27 on the other side of the outer right lateral edge 26 of the hasp-closure actuating lever 21. On the side, good guidance support is present in the depression 20 for the actuating lever 21 by corresponding form-fitting insertion.

As can be noted from FIG. 7, said lateral edge 26 extends beyond the actuating surface 28 of the unlocking slide 25 located below it.

Although the hook engagement member 24 can also be developed as a separate structural part, it is however an integral component of a base plate 29 of the hasp closure I in the embodiment.

Said base plate 29 extends on the left beyond the mounting plate 17 so that the base plate is also directly connected to the shell wall W. The shell edge of the corresponding suitcase shell 2 leaves at that place a receiving space 30 of corresponding shape (see also FIG. 14). This space is defined by parallel side walls 31 which extend in the direction of the hasp closure I and which, together with an outward directed circumferential bend 32, limit the corresponding receiving space 30 together with the shell wall W in three dimensions. The receiving space 30 extends in the region of a continuous circumferential edge bead R of the suitcase 2.

On the bottom of the receiving space 30 there is rooted a bushing 34. A pin 35 which extends from the bottom side of the base plate 29 engages in centering manner into said bushing. The pin 35 of this bushing/pin plug-connection 34/35 is hollow, so that an attachment screw 36 can be inserted from the inside of the suitcase. Similar attachment screws 36 also hold the mounting plate 17 on the shell wall W.

Referred to the base plate 29 there results, via a second one at the attachment screws 26, a combining of shell wall W, bottom 22 of the depression 20, and mounting plate 17 of the hasp closure I. The second attachment screw 26 passes through the flat section of the base plate 29.

The further construction of the hasp closure I itself is as follows: The actuating lever 21 is seated articulated for swinging on a shaft 38 which connects it to the base plate 29. Parallel to the vertically directed shaft 38, there is a shaft 39 on the actuating lever 21 itself which is under the action of a spring 40 which urges it in direction of the closed position of the hasp closure I. On the shaft 39 there is now a closing arm 41, the free end of which passes into a hook 42 which engages in locking manner into an opening 1' of the suitcase shell 1. The locking arm 41 has a convex curvature which is substantially adapted to the curvature of the above-mentioned edge bead R which is designated 33 on the side of the suitcase shell 2. Such an oppositely directed edge bead 43 is also developed on the first suitcase shell 1. Also in this case, the convex top side of the locking arm 41 follows in contour the top side of the two above-mentioned edge beads 33, 43. The corresponding recessed position, which avoids any protrusion, is obtained by a transversely directed slot 44 in the region of the approximately one-quarter bar-like edge beads 33, 43 of the two suitcase shells 1, 2. The transverse slot 44 which is thus formed from two basic structure parts, has a width which corresponds to that of the locking arm 41. The slot 44 and the transverse edges of this recess which defines the depression 20 pass into each other continuously.

Symmetrically opposite the hasp closure I on the pull-handle side there is a second similarly shaped hasp closure II. The reference numerals have been applied in analogous manner without, however, repeating detailed descriptions. A corresponding recess has been provided in logical manner also with respect to the second hasp closure II in the manner that the edge beads 33 and 43 form, also in this case, a common transverse slot 44. The depression 20 there is, however, not produced on an intermediate element in the form of the mounting plate 17 but directly on the shell wall W. In this case also there results the multi-dimensional course of the wall produced by the deep drawing and consequently again high association stability in the corner region 13' which is in any event stiffened by its very nature.

With respect to the mounting plate 17, it should furthermore be pointed out that on the head side of the suitcase K its lateral edge 17' extends congruent to the rounded contour 18' there of the suitcase shell 2, the shell bottom of the suitcase continuing via said rounded contour 18' into the upper region having a carrying handle T, i.e. the top side 19 of the shell wall W. The course of the rounding corresponds concretely also to the course of the edge of the niche 18.

A third hasp closure III is provided in the region of the carrying handle T. For this purpose, the two edge beads 33, 43 of the total edge bead R which is of approximately semi-circular shape as seen in cross section on the outside, leave a third slot 44. The latter extends symmetrically adjacent the carrying handle T of the suitcase. This hasp closure has, in principle, the same features as the two above-described hasp closures I and II. The difference consists in the fact that the hasp closure III has a combination slide 45 for blocking the, in this case, U-shaped unlocking slide 25 which is seated below the actuating lever 21. The unlocking slide is also urged by spring in the direction of its basic position and has bolt latches 25', arranged in pairs, which engage below locking projections 24' which are seated on the narrow sides of two bearing pedestals 46 for the carrying handle T.

Figure 6:
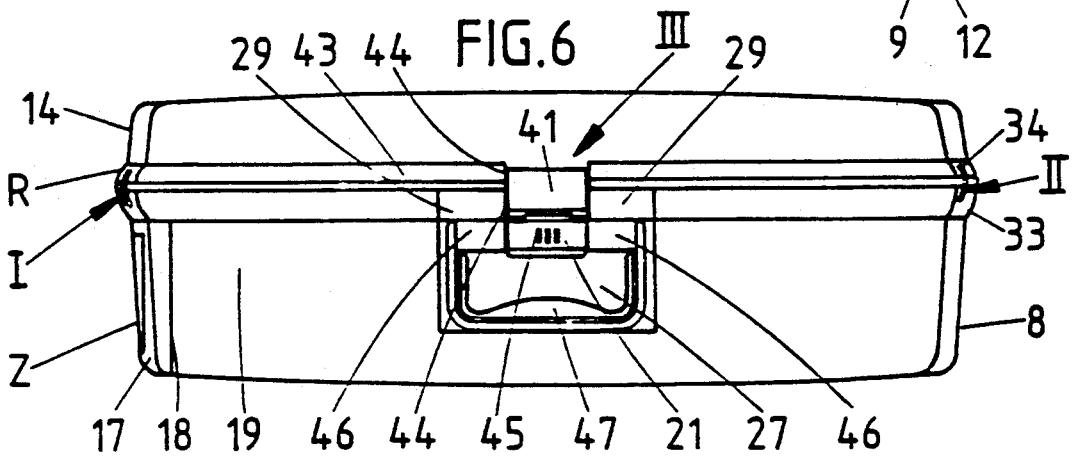
FIG. 6 is a top view.

As can be noted from FIG. 6, the hasp-closure actuating lever 21 swings in such a manner between the bearing pedestals 46 (which are connected as one piece) that the unlocking-slide actuating surface 28 lies free, spaced a distance x from the inner side of the carrying-handle yoke 47 which can be swung into a concealed position. Therefore, in this case also there is obtained a free engagement space within a depression 20.

Taking into account the convex transverse rounding 18' which results on the top side 19 of the suitcase K, there is provided for the recessed arrangement of the carrying handle T or carrying-handle yoke 47 in the contour region of the folded-away yoke 47 a secant-shaped bottom surface 48 for the rounded contour. This bottom surface 48 can be slightly inclined in the form of a roof in the direction towards the broad surface of the suitcase so that no rainwater can collect there. The carrying-handle yoke trough thus created is therefore continuously emptied.

The carrying-handle yoke 47 is spring-urged in the direction of at least partial insertion or folding away. Reference is had in this connection to FIGS. 24–29. As can be noted there, the carrying-handle yoke 47 passes in the region of its mounting ends 47' into oppositely directed journal pins 49. The latter terminate with an inverse collar 50 of larger cross section. The latter engages behind a gate-like open undercut mounting recess 51 on both ends of the common bearing pedestal 46. The latter is screwed from inside the suitcase to the shell wall W so that the transverse-side insertion opening for the journal pins 49 is then closed off.

In one end region, a spring chamber is provided for a return spring which urges the carrying handle T into the folded away position. There is concerned here a torsion spring. The latter is placed on a central support pin 53 of the one bearing end 47'. Concentric to the central support pin 53 there extends an annual spring chamber 54. From it there extends a radially directed, outwardly open longitudinal groove 55 which extends parallel to the support pin 53. The longitudinal groove receives the one end arm 52' of the return spring 52 while the other end arm 52'' rests against a holding shoulder 56 of the bearing pedestal 46 (see FIG. 25).

The yoke 47 is arranged in such a manner that upon assembly a cocking of the return spring 52 results. The attachment of the yoke 47 takes place, referring to FIGS. 24 and 25, from a direction opposite that shown with bottom-side swinging of the yoke 47 into the position shown.

The handle body must in this connection be displaced slightly radially downward since, upon exceeding this 180° spring-cocking position, a blocking edge 57 would come against the corresponding longitudinal edge 58 of the bearing pedestal 46. The preassembly unit therefore is held together even when not yet mounted on the suitcase.

In order to facilitate grasping the U-arm of the yoke 47, the latter extends slightly out of the cross sectional profile of the suitcase. Furthermore, the outside of the carrying-handle yoke arm is aligned with the transition edge to the aforesaid bottom surface 48 into the rounding while its end side forms a gusset 59 with the rounding. The gusset can be easily grasped with one's fingers if the grasping is not in any event introduced via the free gripping space 27.

Figures 8, 9, 10, 11, 12, 13:
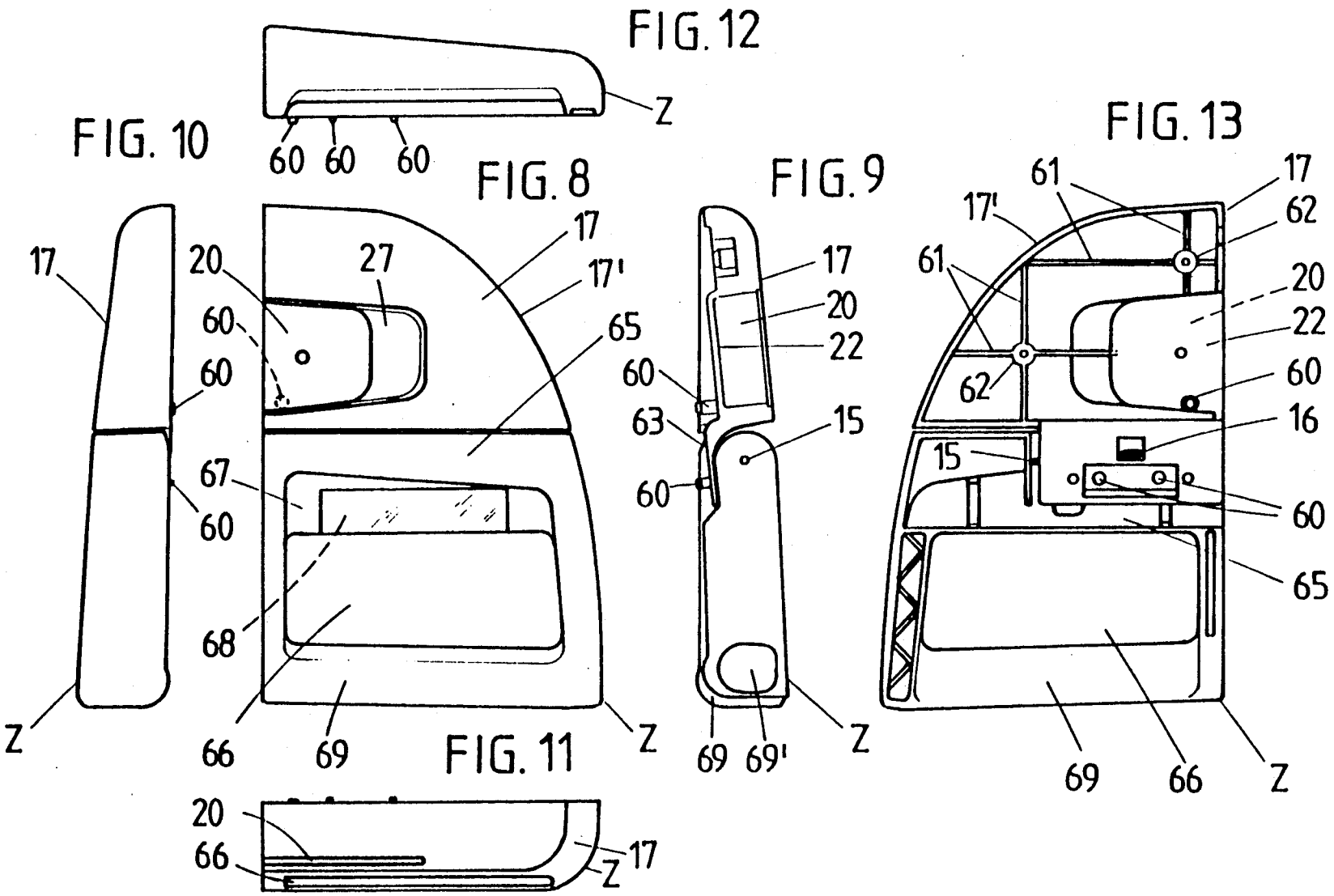
FIG. 8 shows the structural unit consisting of mounting plates and pull handle in detail, in front view.
FIG. 9 is a right side view.
FIG. 10 is a left side view.
FIG. 11 is a top view of the same.
FIG. 12 is a bottom view.
FIG. 13 is a rear view of the unit mounting plate/pull handle.
Figure 15:
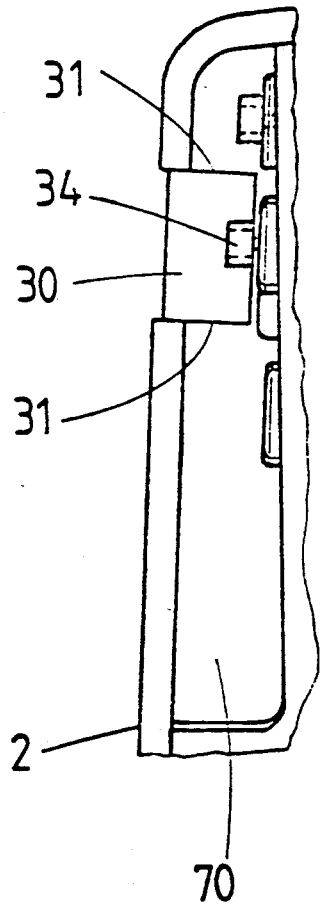
FIG. 15 is a left side view.

With regard to the attachment it must also be noted that in addition to the above-mentioned screw attachment between mounting plate 17 and shell wall W, there is provided a bushing/pin plug-connection which acts as a set pin. For this purpose, at least one pin 60 extends as a set pin from the bottom 22 of the depression 20. Reference is had to FIG. 13 from which there can also be noted two additional set-pin like pins 60 which extend from the rear of the hinge bearing of the pull handle Z.

It can furthermore be noted from the same figure that the hollow bottom side of the mounting plate 17 which is also developed as a shell, has intersecting stabilizing webs 61. At their points of intersection bushings 62 extend for the insertion of the attachment screws 36 which are screwed in from the inside of the suitcase. The stabilizing webs are also rooted in the outer surfaces of the depression 20 and, therefore, additionally stabilize same.

The pull handle Z is in an end-stop position which can be noted from FIG. 9 and in which at least one of its arms strikes against a base plate of the bearing pedestal which supports the pull handle at the rear.

Figure 18:
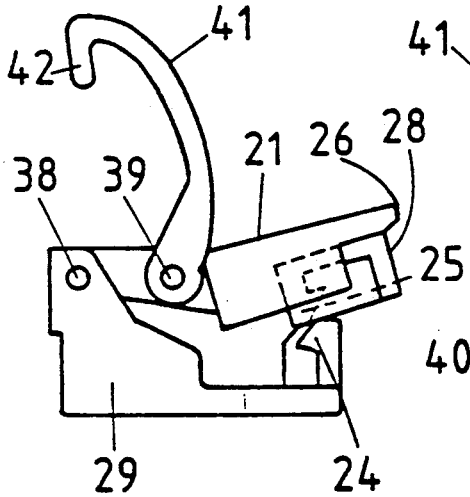
FIG. 18 is a second hasp closure shown in side view in a detailed, opened.
Figure 20:
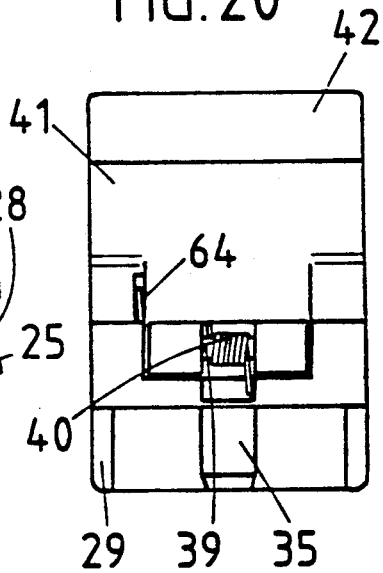
FIG. 20 is a left side view.
Figure 21:
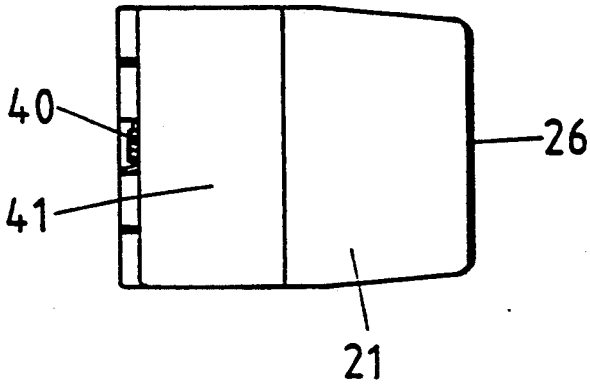
FIG. 21 is a top view thereof.
Figure 26:
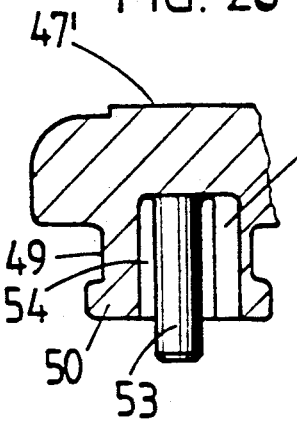
FIG. 26 is a section through the one mounting end of the carrying handle.
Figure 25:
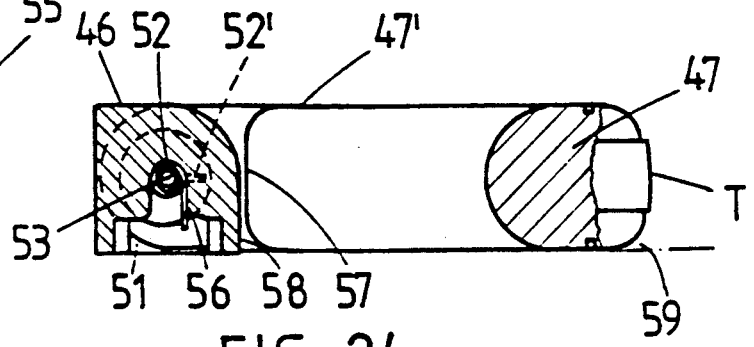
FIG. 25 is a section along the line XXV—XXV of FIG. 24.
Figure 24:
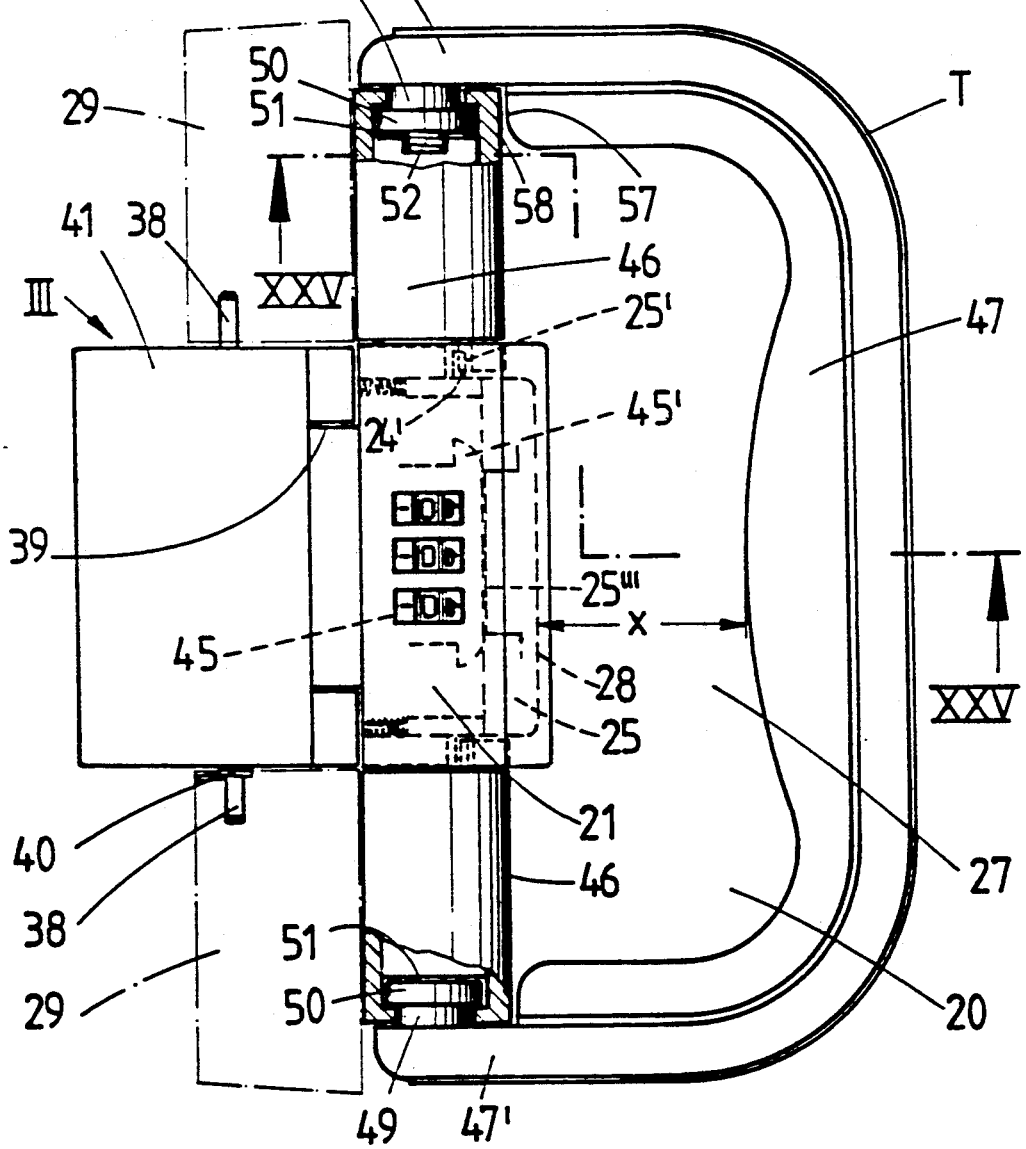
FIG. 24 is a top view of a third hasp closure in the region of the carrying handle of the suitcase, the mounting places of the carrying handle being partially broken away.
Figure 29:
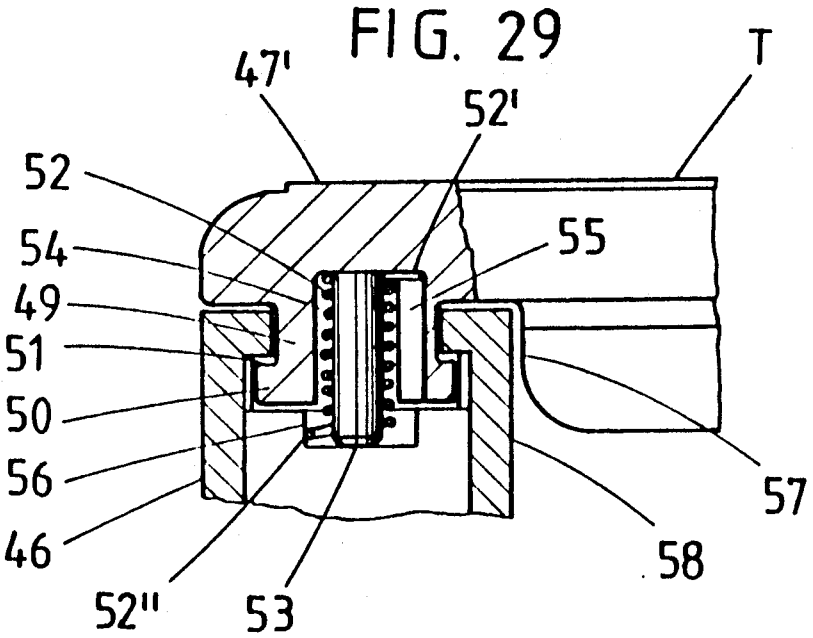
FIG. 29 shows the introduction of the bearing shaft connection, the cocking of the return spring being brought about by subsequent turning of the bearing pedestal by 180° relative to the carrying handle.
Figure 28:
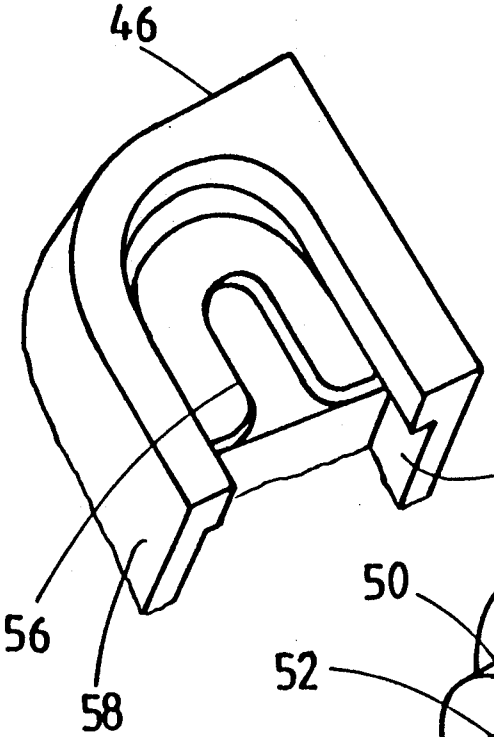
FIG. 28 is the corresponding bearing recess.
Figure 27:
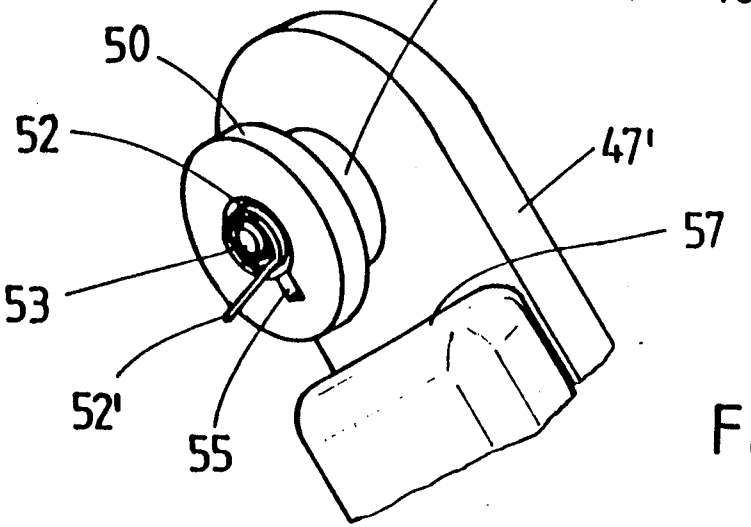
FIG. 27 shows same in perspective with the return spring which urges the carrying handle into the folded position.

In the case of all hasp closures I to III, a return spring effects the placing of the closure arm 41 into its stop-limited open position (see for instance FIG. 18). This return spring bears the reference numeral 64 in FIG. 7 and is seated on the shaft 39.

Finally, the pull handle Z is further developed in such a manner that its arm 65 on the forms on the mounting plate side inside of its pull handle lug 66 a flat surface 67 which rises in roof-like manner. The latter bears a name plate compartment 68. The name plate can be inserted through a transverse slot (not shown in detail) and is advisedly protected against direct contact by a transparent or translucent covering glass. The other arm 69, which extends parallel to the mounting plate-side arm 65, is the actual grasping handle. As can be noted from FIG. 9, it is hollow. The opening 69' of the hollow is covered, concealed from view, by the niche 18 which receives the assembly unit consisting of mounting plate and pull handle 17/Z.

Figure 14:
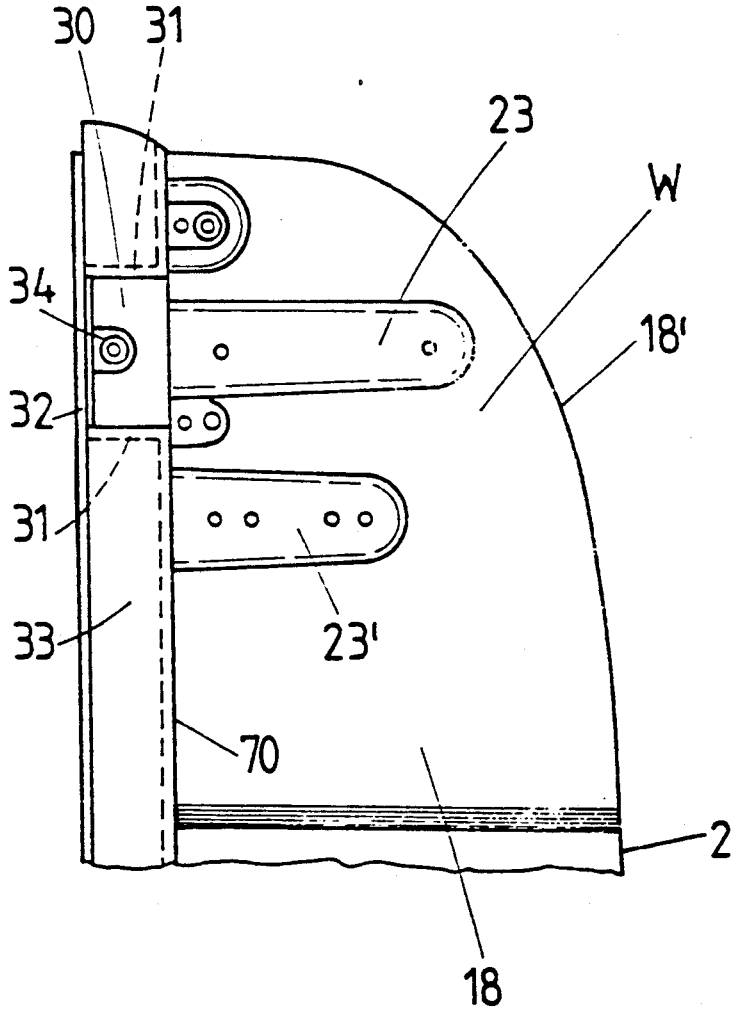
FIG. 14 shows the niche in the shell wall of the one suitcase shell which niche is adopted to receive said unit.
Figure 22:
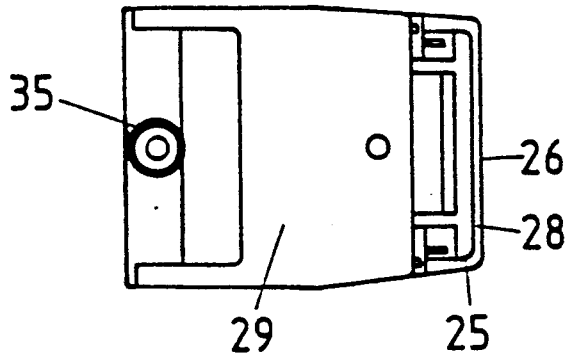
FIG. 22 is a bottom view of the hasp closure.

As can be noted from FIG. 14, another depression ledge 23' which has been also pressed out from the inside, extends parallel to the depression ledge 23, said depression ledge 23' having the insertion holes for the set pins 60 of the pull handle bearing pedestal or the mounting plate 17.

In the case of the hasp closure III, the ends of the shaft 38 are seated in bearing recesses of divided base plates 29 which are screwed fast from the inside on the top side 19.

The permutation lock (combination lock 45), which has a key-code resetting device, is of known construction. It has a locking plate 45' which can be swung as a function of the setting disks and cooperates with a blocking projection 25''' of the unlocking slide 25.

All three hasp closures I to III are clamping closures which extend beyond a dead center position.

Figure 30:
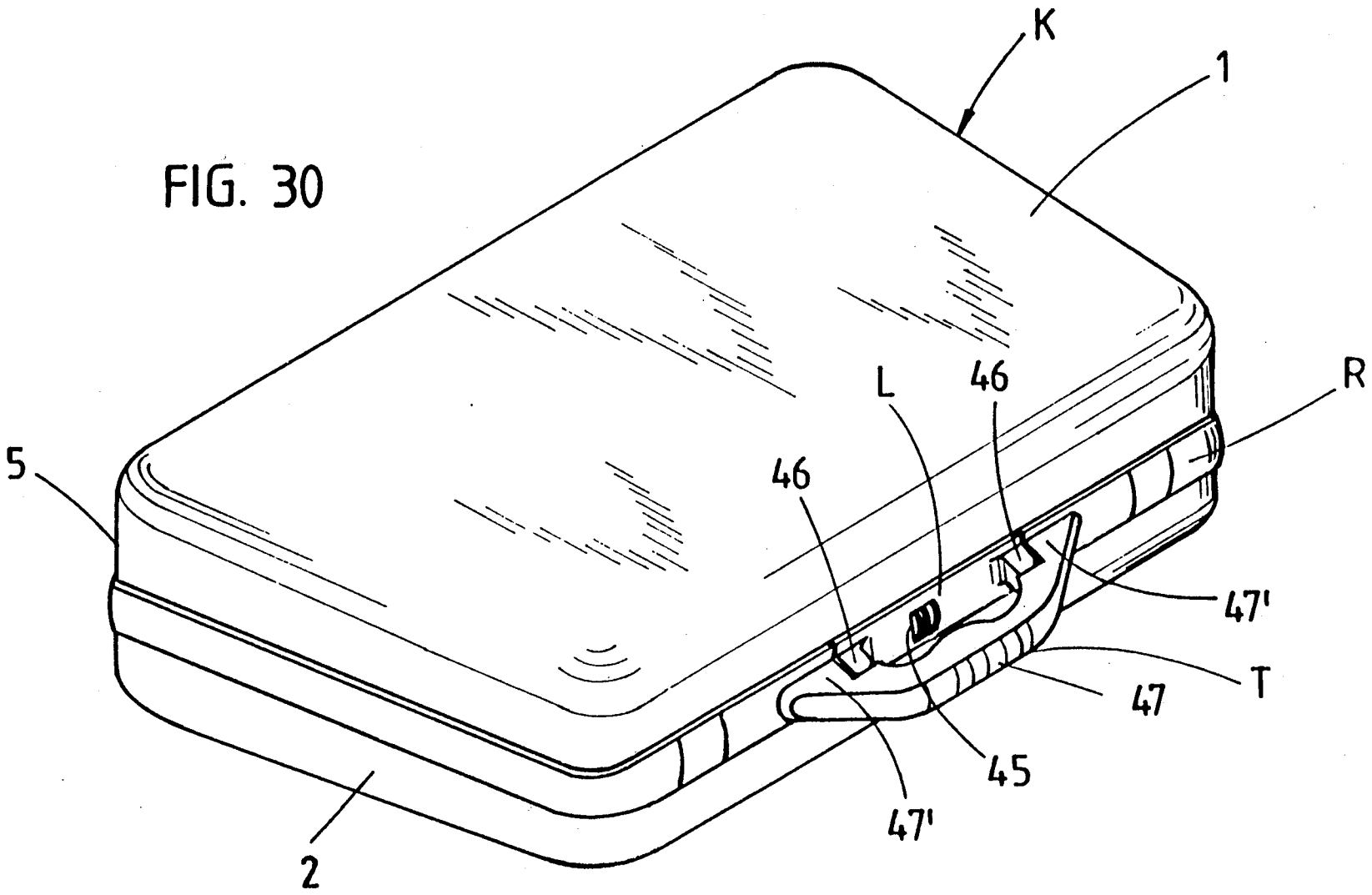
FIG. 30 shows the suitcase in a modified embodiment, in perspective, laid down and with the carrying handle folded out ready for grasping.
Figures 31, 32:
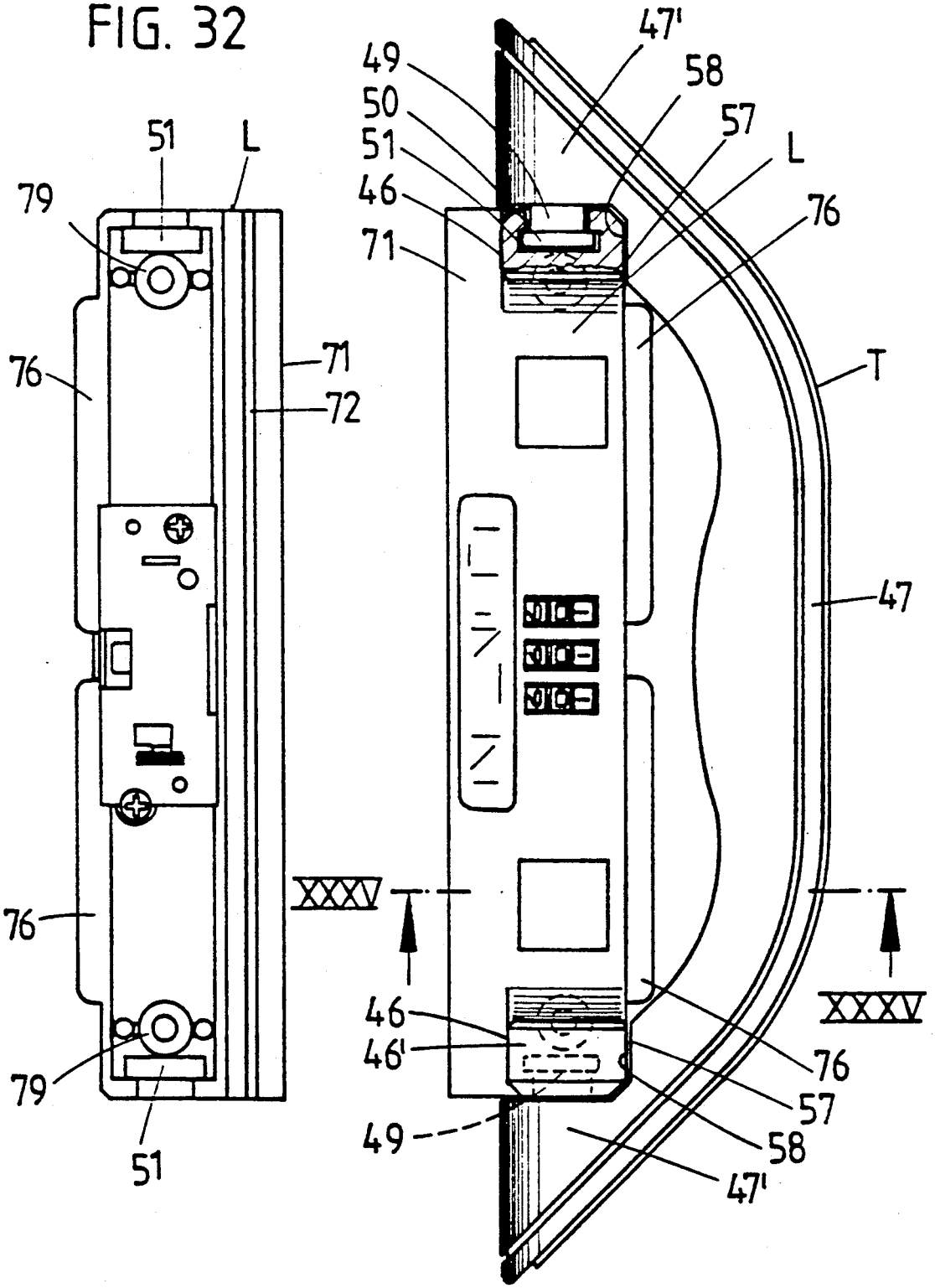
FIG. 31 is a top view of the corresponding carrying handle with the mounting places thereof, one of which, i.e. the one bearing pedestal of a joint bearing pedestal ledge being partially broken away.
FIG. 32 is the bottom view of this ledge without the carrying handle.

In the modified form of suitcase K shown in FIG. 30, additional details of the development and attachment of the carrying handle T will be explained below. Also in this case, the latter is attached to the suitcase shell 2 which forms the case of the suitcase. The reference numerals have been used by analogy, without, however, repeating all identical technical details.

In this case, the carrying handle T has a trapezoidal shape, i.e. the bearing ends 47' of the carrying-handle yoke 47 diverge on the suitcase side. Accordingly, the manner of articulation explained with reference to FIGS. 25 to 29 is somewhat different in construction, the basic principle, which has been explained above, being however retained but with the elimination of the provision of a return spring which urges the carrying handle T in the direction of a given folded away position.

In detail the following construction results: The two bearing pedestals 46 extend, with respect to mounting, from a common relatively flat ledge L, the bearing pedestals 46 which extend in the direction of the ledge L being clearly shorter than in FIG. 6. They still correspond only to a length such as required for the length of the rather short journal pins 49. From the bottom side of the bearing pedestals 46, there again extend bearing recesses 51 which, while retaining the above-mentioned gate shape, form the insertion openings there for the journal pins 49. Upon the fixing of the ledge 60 these insertion openings are closed, namely by the shell wall of this suitcase shell 2.

Despite the diverging, i.e. obliquely rising course of the mounting ends 47' of the carrying-handle yoke 47, the bearing pedestals 46 or their mounting recesses 51, respectively extend substantially perpendicular to the direction of the ledge, which direction corresponds substantially to the straight edge of the suitcase. The bearing pedestals 46 thus enter into an angular recess at the foot of the mounting ends 47'. In this connection, the above-described blocking edges 57 extend also here at a distance from the journal pins 49 on the yoke side on the carrying handle T. The blocking edges cooperate with the longitudinal edge 58 of the bearing pedestal 46 which edge acts as guide upon assembly. The longitudinal edge 58 of the bearing pedestal 46 then passes into a convex end surface 46' which is adapted to the required swing of the carrying handle and clears the swing path so that the blocking edge 57 which comes into this region upon completion of the assembly and extends, upon plug connection, parallel to the longitudinal edge 58 can slide unimpeded and in guided manner over the convexly curved end surface 46'. In contradistinction to the development according to FIG. 28, the carrying handle T can now be folded away as desired to one or the other side of the gripping position or, when the suitcase is standing, it can fold itself away out of the neutral standing position.

In order, also in this case, with the shortest possible shaft stub as journal pin 49, to prevent detachment from the mounting recess 51, for instance upon the action of extreme stresses on the yoke, the journal pins 49 again form a collar 50 of larger diameter. The latter slides upon assembly, guided in rail-like manner, into the correspondingly shaped undercut in the pocket-like mounting recess 51, up to the concave end thereof. Reference is furthermore had to the above detailed explanations concerning this. The outwardly directed end sides of the bearing pedestals 46 are cut correspondingly for passage of the journal pins 49.

Figures 33, 34:
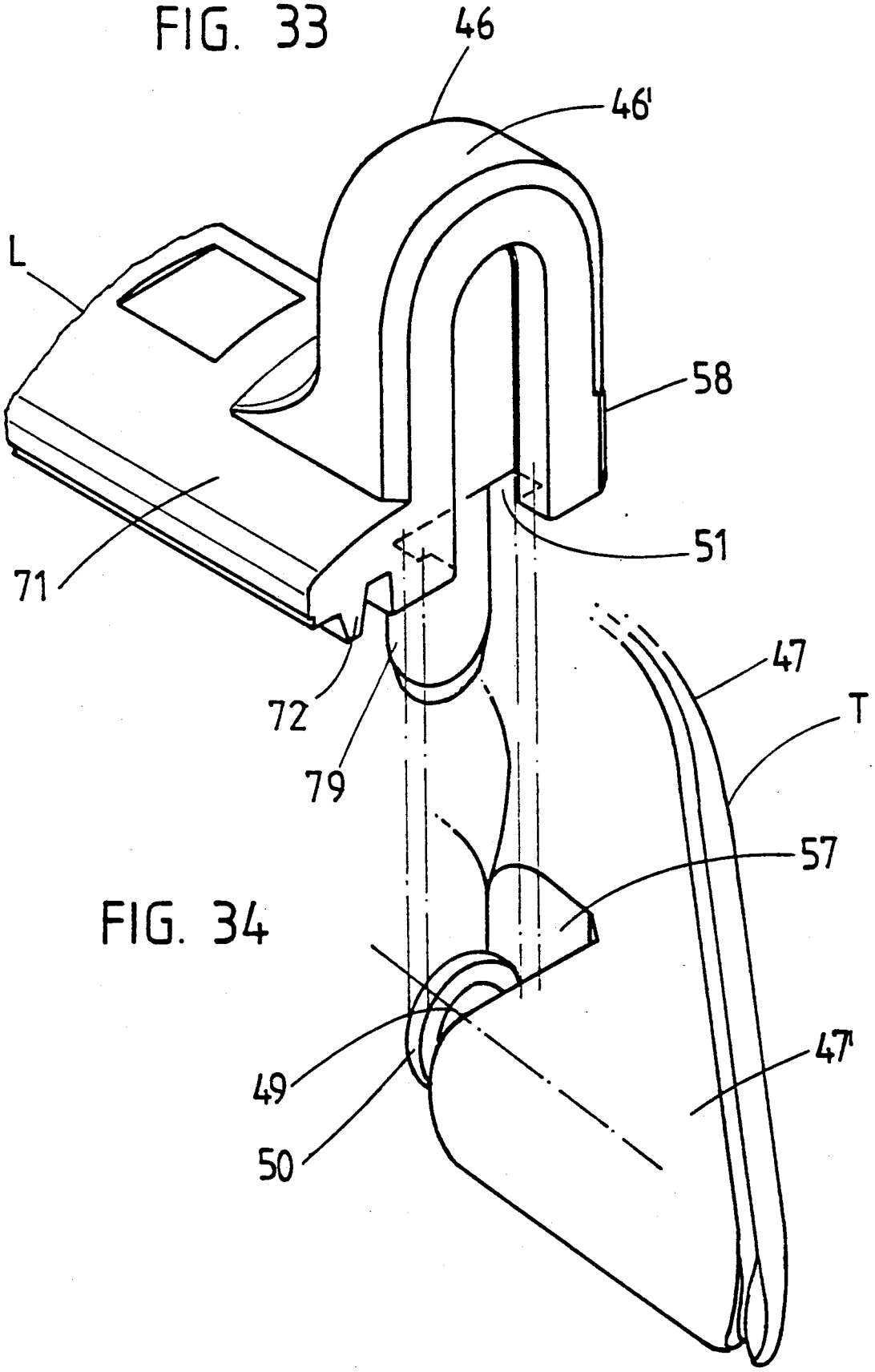
FIG. 33 shows in perspective the one bearing pedestal with the bearing recess.
FIG. 34 shows also in perspective the carrying-handle end to be mounted with journal pin and blocking edge 57.
Figure 35:
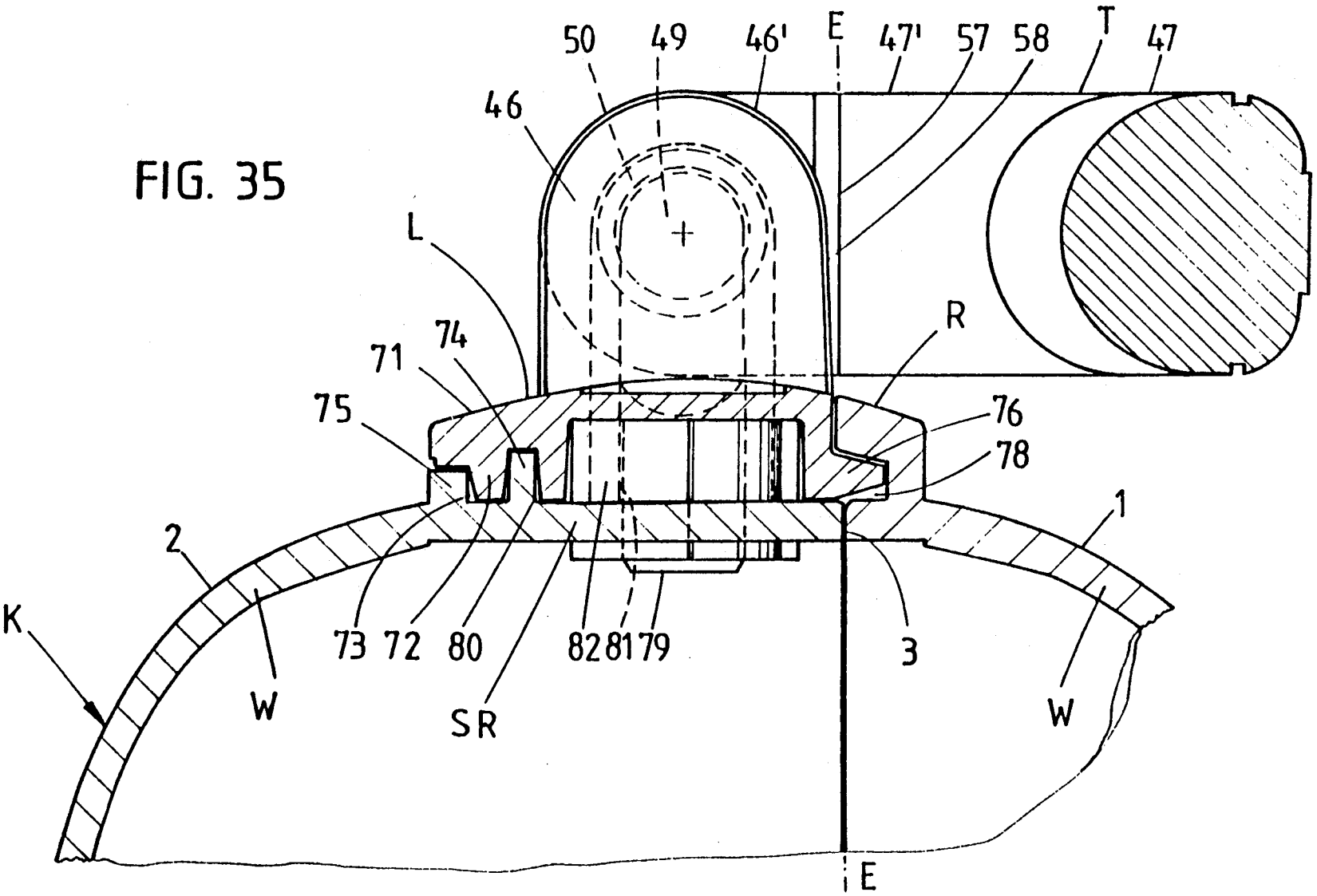
FIG. 35 is a section along the line XXXV—XXXV of FIG. 31, shown on a larger scale than in FIG. 31.

In general, a well-defined carrying handle assembly can be assured from the start if the ledge L forms a blocking projection 71 on one longitudinal side, at least in the region of the bearing pedestals 46. This can be noted particularly clearly from FIG. 33 and shows that the "threading in" of the carrying handle T effected from above the ledge is not possible from this longitudinal side, its path being blocked by the blocking projection 71. Measures of this type have advantages in case of magazine feeding, in particular also for the creation of preassembly units consisting of ledge and carrying handle (L/T) in given alignment to the machine assembly.

The advantages of such an accumulation of material is, however, not exhausted by this. It contributes to the further surface stabilization of the ledge L itself and also effects a doubling of the wall as compared with the wall of the shell edge (see FIG. 34). The corresponding shell edge is designated SR. It is furthermore this edge which blocks the entrance, i.e. the insertion opening, of the mounting recess 51.

With reference to the blocking projection 71, there is also a further development in that, in the region of this blocking projection the ledge L is, via a longitudinal rib 72 on the suitcase side in form-locked engagement with the shell edge SR which is provided on the outside, open towards the blocking projection 71, with a corresponding longitudinal groove 73 for the form-locked engagement. Said longitudinal groove 73 is limited laterally by jaws 74 and 75 which extend beyond the top side of the shell edge SR and are formed there on the shell edge SR. The jaw 74 closer to the carrying handle T has a greater standing height than the peripheral jaw 75. In the direction of insertion, the longitudinal rib 72 tapers down slightly trapezoidally so that there is a kind of centering aid for the attachment of the ledge L. The longitudinal rib extends over the entire length of the ledge L.

On the longitudinal side of the ledge L facing away from the blocking projection 71, there is an engagement tongue 76 which is formed from the start on said ledge. The engagement tongue extends over the fold joint 3 of the suitcase shells 1, 2 and engages into the corresponding wall of the suitcase shell 1 which forms the cover of the suitcase K. The form-locked engagement, which is present also in this case, is brought about by a recess 78, provided in the region of the engagement tongue, in the wall of the suitcase shell 1 there. As a whole, there is present there a U-profile of the shell edge opening in the direction of the engagement tongue 76 which extends perpendicular to the fold joint. In this way, the load is transferred to the entire suitcase body, i.e. also to the suitcase shell 1.

The blocking projection 71 which is formed by the ledge L which is formed flatly transversely arched on top, finds its counterpart on the longitudinal side facing away from it due to the said U-profile of the edge there so that there is present also an optically well-balanced bracket profile of the ledge which continues with the same profile into the circumferential edge bead R of the suitcase K.

In the rear and, therefore, on the suitcase side plug projections 79 extend in the immediate vicinity, to the side of the mounting recesses 51, in each case on the bottom side of the ledge L. Congruent thereto, a depression 80 which receives the ledge L forms respective openings 81 pointing in the opposite direction and continuing into a collar 82 on the ledge side. The plug projection 79, which tapers slightly conically towards the free end, is hollow centrally, which serves to receive a screw which can be screwed in from the inside of the suitcase and which in this manner holds the ledge L on the shell edge SR. Due to its protrusion on the inside of the suitcase, in case of a suitable selection of material, the plug projection 79 can also be expanded thermally, for instance in the manner of a hollow rivet.

The suitcase shown in FIGS. 30 to 35 can also be developed further in the same manner as the suitcase described in FIGS. 1 to 29, i.e. it can also be provided with castors 9 and have the hasp closures I–III.

We claim:

1. A suitcase comprising a first suitcase shell, a second suitcase shell, and a fold joint serving as an interface between said first suitcase shell and said second suitcase shell upon a folding of said first and said second suitcase shells together;

a plurality of castors, a pull handle, and a mounting plate which is attached to said second suitcase shell, one of said casters being mounted to said first suitcase shell and a second of said castors being mounted to said second suitcase shell;

wherein each of said suitcase shells has a narrow side and a wide side, and said pull handle is located on the narrow side of said second suitcase shell opposite said second caster and is swingably seated on said mounting plate;

said suitcase further comprises at least one closure which extends over said fold joint for connecting said second suitcase shell to said first suitcase shell; and said closure comprises a hasp closure, there being an interpenetration between said hasp closure and said mounting plate upon a closing of said suitcase.

2. A suitcase according to claim 1, wherein said hasp closure has an actuating lever; and said mounting plate has a depression which engages with said hasp-closure actuating lever.

3. A suitcase according to claim 2, wherein said mounting plate sits upon a wall of said second suitcase shell; and said depression has a bottom which rests on said shell wall.

4. A suitcase according to claim 3, wherein said hasp closure lever has a hook engagement member, the hook engagement member for the hasp-closure actuating lever being seated on the bottom of said depression.

5. A suitcase according to claim 4, wherein said hasp closure has a base plate situated upon the bottom of said depression; and said hook engagement member is seated on said base plate of the hasp closure.

6. A suitcase according to claim 5, wherein said hook engagement member has a screw-in cavity disposed on said hasp base plate for an attachment screw.

7. A suitcase according to claim 6, wherein said hasp actuating lever has a lateral edge extending parallel to an interface between said first and said second suitcase shells;

a top side of the hasp-closure actuating lever is aligned with an upper edge of said depression; and said depression leaves a free engagement space alongside said lateral edge of the hasp-closure actuating lever.

8. A suitcase according to claim 2, further comprising an unlocking slide located at the hasp-closure actuating lever.

9. A suitcase according to claim 2, wherein said hasp closure has a locking arm terminating in a hook;

an interfacing edge of each of said suitcase shells at said fold joint is formed as a bead; and said locking arm of the hasp closure is bent in longitudinal direction, perpendicular to said fold joint, to provide a concave side which rests against said beads of said suitcase shells upon a closure of said suitcase.

10. A suitcase according to claim 1, wherein said pull handle has an arm located on a mounting plate-side of said pull handle, said pull-handle arm comprising a flat surface which slopes to establish a nameplate compartment.

11. A suitcase according to claim 1, further comprising a second hasp closure of similar shape to said first-mentioned hasp closure, said second hasp closure being located symmetrically opposite said first hasp closure and adjacent said pull handle.

12. A suitcase according to claim 1, wherein a wall of said second suitcase shell includes an inwardly recessed niche; and said pull handle and said mounting plate are recessed in said inwardly recessed niche.

13. A suitcase according to claim 1, wherein said first suitcase shell is hinged to said second suitcase shell at a bottom of said suitcase;

a wide side of said second suitcase shell meets a wall portion of said second suitcase shell via a rounded contour at a top of said suitcase opposite said suitcase bottom;

said suitcase has a carrying handle connected at said top to said second suitcase shell; and said mounting plate has a lateral edge which extends on the top of said suitcase congruently to said rounded contour adjacent said carrying handle.

14. A suitcase according to claim 11, wherein an interfacing edge of each of said suitcase shells at said fold joint is formed as a bead;

there is a depression in a wall of said second suitcase shell; and said second hasp closure is also recessed in a slot formed by said beads and said depression in said second shell wall.

15. A suitcase according to claim 14, further comprising a third hasp closure, and an unlocking slide; and wherein said beads leave free a third slot symmetrically adjacent to said suitcase carrying handle in which there is recessed said third hasp closure; and said third hasp-closure has an actuating lever bearing a combination lock for blocking said unlocking slide, said unlocking slide being arranged below the actuating lever of said third hasp closure.

16. A suitcase according to claim 15, further comprising bearing pedestals for connecting said carrying handle to said second suitcase shell, said carrying handle having a yoke;

locking projections which are seated alongside said bearing pedestals; and wherein said unlocking slide forms, on sides of said combination lock, housing bolt latches which engage said locking projections; and between said bearing pedestals, said third hasp-closure actuating lever is operative to expose an actuating surface of said unlocking-slide at a distance from an inside of said suitcase carrying-handle yoke.

17. A suitcase according to claim 16, wherein said second suitcase shell has a trough for receiving said carrying-handle yoke, said trough having a bottom surface lying in secant form to said rounded contour at the top of said suitcase; and said suitcase carrying-handle yoke is spring-loaded in a retraction direction against a bottom surface of said carrying-handle yoke trough.

18. A suitcase according to claim 17, wherein said carrying-handle yoke is contoured to follow a transition edge of the bottom surface of said trough, and includes a side rounded region.

19. A suitcase according to claim 18, wherein each of said bearing pedestals has a journal pin; and said carrying-handle has a return spring which comprises a torsion spring and which is seated on one of said journal pins.

20. A suitcase according to claim 2, further comprising a bushing/pin plug-connection disposed between said mounting plate and a contiguous portion of wall of said second suitcase shell, there being furthermore a screw attachment between said mounting plate and said wall portion.

21. A suitcase according to claim 20, further comprising at least one pin extending from the bottom of the depression of said mounting plate to said wall portion contigous said mounting plate.

22. A suitcase according to claim 1, wherein said mounting plate has a hollow underside with intersecting stabilizing webs and bushings at points of intersection of the stabilizing webs.

23. A suitcase according to claim 14, wherein said first hasp closure has a base plate;

said suitcase further comprises a bushing/pin plug-connection between the base plate of said first hasp closure and a wall of said second suitcase shell in a region of a receiving space which intersects one of said edge beads.

24. A suitcase according to claim 16, wherein said second suitcase shell has a common ledge for seating said bearing pedestals;

said suitcase comprises journal pins for securing said carrying handle to said suitcase;

said bearing pedestals have mounting recesses which have insertion openings for receiving said journal pins; and during retraction of said carrying handle said insertion openings are closed off by a wall of said second suitcase shell.

25. A suitcase according to claim 24, wherein said mounting recesses extend substantially perpendicular to a direction of said ledge.

26. A suitcase according to claim 25, wherein a top of said second suitcase shell comprises spaced from the journal pins, blocking edges which face a yoke side of said carrying handle for cooperation with longitudinal edges of said bearing pedestals to form a guide assembly; and wherein each of said bearing pedestals has a convex end surface aligned to a path of swinging of said carrying handle.

27. A suitcase according to claim 25, wherein said journal pins form a collar for introduction into corresponding undercuts of said mounting recesses.

28. A suitcase according to claim 24, wherein said ledge in a region of the bearing pedestals includes a blocking projection which prevents insertion and/or removal of said carrying handle.

29. A suitcase according to claim 28, wherein said ledge includes an elongated rib;

said ledge is in form-locked engagement which said second suitcase shell in a region of said blocking projection via said elongated rib; and said second suitcase shell has an elongated groove for receiving said elongated rib.

30. A suitcase according to claim 29, wherein said ledge extends into a tongue for engagement with a wall of said second suitcase shell.

* * * * *